US005921797A

United States Patent [19]

Bass et al.

[11] Patent Number: 5,921,797

[45] Date of Patent: Jul. 13, 1999

[54] ELECTRICAL CONNECTOR FOR USE WITH REMOVABLE ELECTRONIC CONSOLE

[75] Inventors: Timothy Scott Bass, Greensboro; Luka Gregory Korzeniowski, Winston-Salem, both of N.C.

[73] Assignee: The Whitaker Company, Wilmington, Del.

[21] Appl. No.: 08/992,437

[22] Filed: Dec. 17, 1997

[51] Int. Cl.[6] ..... H01R 4/50

[52] U.S. Cl. ..... 439/342; 439/137

[58] Field of Search ..... 439/342, 140, 439/141, 137, 145

[56] References Cited

U.S. PATENT DOCUMENTS

| | | | |
|---|---|---|---|
| 4,463,998 | 8/1984 | Reavis et al. | 339/40 |
| 4,475,784 | 10/1984 | Lukawich | 339/43 |
| 4,538,871 | 9/1985 | Li | 339/75 M |
| 4,722,693 | 2/1988 | Rose | 439/137 |
| 4,758,536 | 7/1988 | Miller et al. | 439/138 |
| 5,020,997 | 6/1991 | Calderara et al. | 439/137 |
| 5,340,338 | 8/1994 | Sai et al. | 439/845 |
| 5,702,259 | 12/1997 | Lee | 439/137 |

*Primary Examiner*—Gary F. Paumen
*Assistant Examiner*—Antoine Ngandjui
*Attorney, Agent, or Firm*—Bradley N. Ditty

[57] ABSTRACT

A portable electronic component transport and interconnection assembly 2 includes a removable console 50 that can be mounted in a host or vehicle and connected to a permanently mounted output connector 10 by simple linear longitudinal movement followed by linear lateral movement. The removable console 50 includes input contact members 62, 64 and 66 for connecting the console to a source of power, ground and electrical signals. The input contact members are L-shaped with a contact interface 72 located on the rear of the input contact member. The output connector includes a curved resilient contact 12 that is located on the inside of a connector front wall adjacent to one of several openings 30, 32, 34. A spring loaded door 40 normally closes these openings, but the input contact members push this door 40 during initial longitudinal movement. The input contact members are then moved laterally so that the contact interfaces 72 engage corresponding resilient contacts 12. The input connector 60 can also include a spring loaded shield 74 surrounding the input contact members, that is shifted upon engagement with the exterior of the output connector 10 during mating.

27 Claims, 8 Drawing Sheets

10
38
22
36
46
49
47
37
35
44
45
42
42
42
12
14
16
12
14
16
12
14
16
40
30
28
32
24
34
26

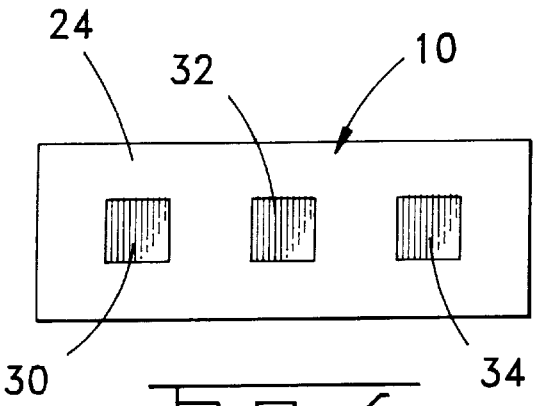
Fig. 6
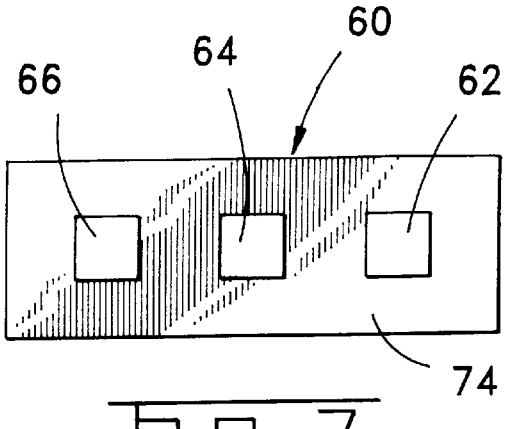
Fig. 7
Fig. 8
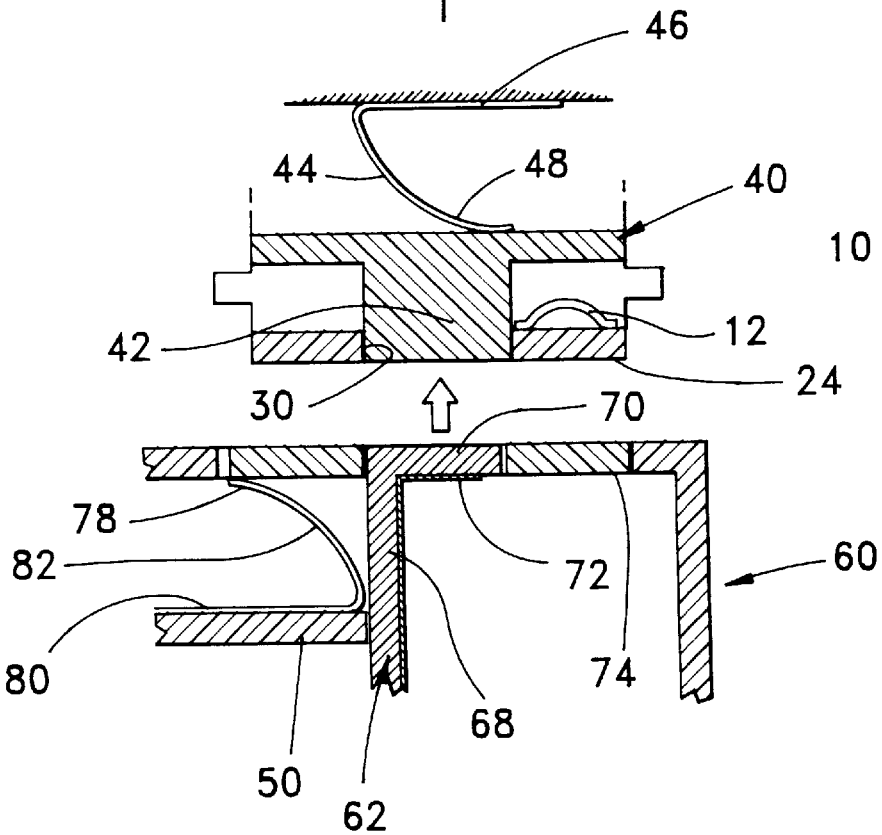

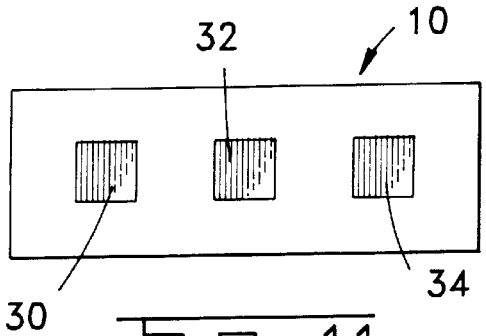
Fig. 11
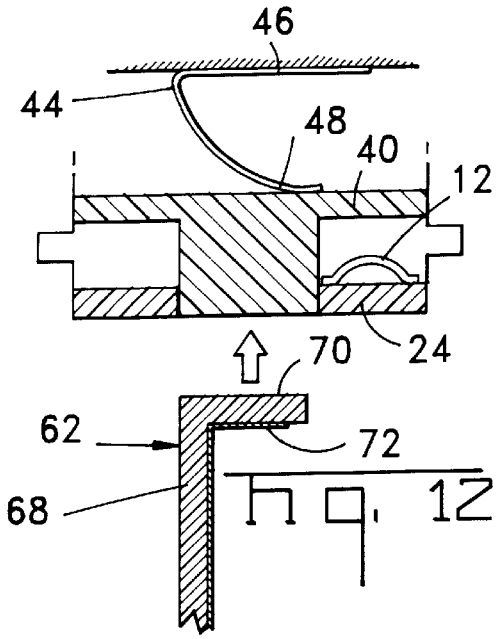
Fig. 12
Fig. 13
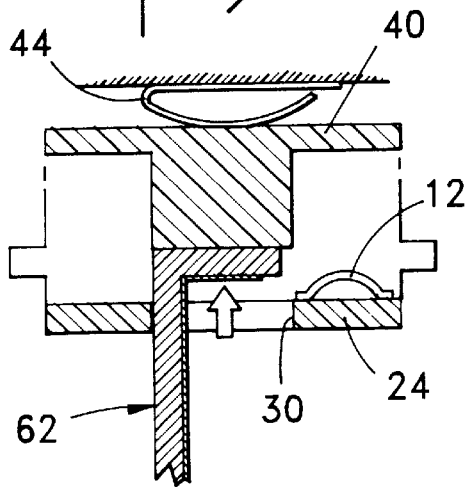
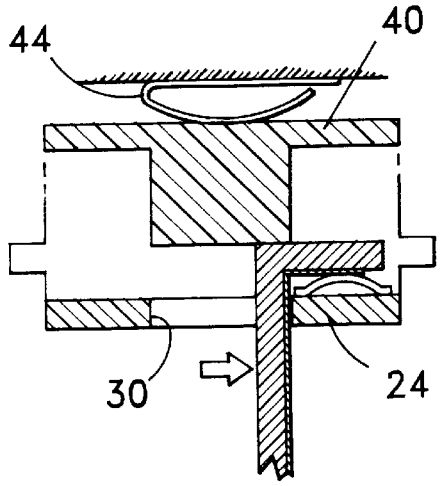
Fig. 14
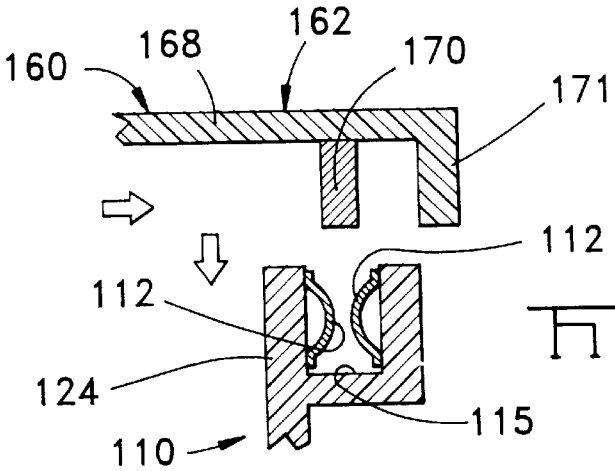
Fig. 15

ELECTRICAL CONNECTOR FOR USE WITH REMOVABLE ELECTRONIC CONSOLE

BACKGROUND OF THE INVENTION

1. Field of the Invention

This invention is related to an electrical connector and to a console assembly for use in connecting electronic devices to a source of electrical services, including power, ground and signal. This invention is specifically related to apparatus for use with a plurality of portable electronic components, such as computers, cellular communications equipment, ground positioning satellite (GPS) equipment, and other electronic equipment. Devices of this type can be mounted in portable container, such as a console, briefcase, or other carrier and which can be plugged into a common source of electrical services in for example an automobile. This invention is specifically directed to matable electrical connectors through which an electrical interface can be established merely by positioning or mounting the portable device in the automobile or other host.

2. Description of the Prior Art

Portable electronic devices, such as laptop computers, cellular telephones, ground positioning satellite (GPS) receivers, printers, CD players and electronic game equipment are typically battery powered, but do permit connection to an external source of electrical power to recharge the batteries or to permit the device to be operated without draining the battery. It is increasingly common to use these devices in automobiles, recreational vehicles, boats, or motor vehicles in general. Typically When one of these devices, such as a rechargeable cellular telephone is employed in an automobile, the battery charger or telephone cradle is connected to the cigarette lighter to provide access to a source of electrical power. Other devices, such as CD players or radios are permanently mounted in the automobile and have permanent connections. However, with the increasing number of such portable electronic devices that are available, access to electric power for all of these devices is increasingly difficult, especially in family vehicles. Even for those devices that can be permanently mounted in a vehicle, theft is an increasing concern. Of course portable devices are even more susceptible to theft.

One approach to solving these problems arising from the proliferation of portable electronic devices is to mount all of these devices in a portable and removable console, case, container or carrier that can be easily removed from and reinstalled in an automobile. This remote console would include an input electrical connector that could be used to connect to electrical services available in the motor vehicle or other host for the removable console and the portable devices mounted therein. A permanent output connector would be mounted in a wall, partition or floor of the automobile or host. For example a permanent output connector could be mounted in a partition between the front seats of a motor vehicle or in the floor between the front seats. The removable console or carrier could then be mounted adjacent to or over this connector. A cord could be used to connect the remote console and the portable electronic devices therein to the electrical services, such as power, ground and signal, supplied by the host or the motor vehicle. However a more satisfactory approach would be to provide an input connector on the remote console that could be plugged into or mated with the permanent output connector when the remote console or case was physically mounted in the vehicle. This approach would require a relatively simple movement of the remote console or case in order to insure reliable connections, as well as efficient mounting of the remote console in the vehicle.

Several problems exist if a removable console is to be used to support multiple remote electronic devices. First the connection to a power supply must be suitable for carrying a relatively large current. For example, a rating of 20 AMPS would be required for supplying power to multiple components. Although electrical contacts, such as the spring contact band generally shown in U.S. Pat. No. 5,340,338, do have a current rating that would be sufficient for such applications, they have not been incorporated in a connector that can be easily mounted in the manner required for this type of application. Furthermore, the output connector contacts must remain inaccessible when not in use to prevent children or other occupants from making contact with live conductors. Another problem is that a permanently mounted connector in a motor vehicle or other host must be capable of withstanding relatively harsh environmental conditions. For example, the permanently mounted output connector must not be adversely affected by spills or vapor condensation.

One approach to isolating live conductors from inadvertent contact by occupants and users and from inadvertent contamination is to provide doors or covers over the live contacts or sockets. This problem has been addressed for electrical outlets used in buildings or homes, where movable doors have been positioned to cover the female or live contacts in the outlets. At least two types of doors are used. U.S. Pat. No. 4,463,998 discloses a representative example in which sliding doors can be used to cover live contacts in a standard branch circuit outlet. The male tabs on a plug can be inserted into slots in the closed cover and force can be applied to laterally move the covers into alignment with the contacts. However, for this device, the user grasps the plug and can therefore easily insert the plug into the small slots of the cover. This approach would present problems when the user is attempting to insert a relatively large and perhaps heavy console or cover. Another approach is to use a pivoted cover, such as that shown in U.S. Pat. No. 4,758,536 in which the cover pivots inwardly to permit insertion of a mating plug. This approach, however, requires additional space and could be opened rather easily by a child.

SUMMARY OF THE INVENTION

The apparatus disclosed and claimed herein comprises an assembly, and its subcomponents or subassemblies, for delivering electrical power and other electrical services such as ground and signal communication to portable electrical or electronic components or devices. The apparatus includes a removable console or case and a permanently mounted output electrical connector or socket. The portable electrical or electronic components or devices are housed in the removable console or case and the case includes an input electrical connector matable with the output electrical connector or socket. The output electrical connector includes a plurality of resilient contacts mounted adjacent to openings in a front wall of a connector housing. In the preferred embodiment, these resilient contacts are louvered contact bands that have a curved or convex contact section that exerts a spring force when radially deformed. The resilient contacts flex both radially and transversely when mated with input contact members in the mating input connector on the removable console or case. In the preferred embodiment of this invention, the resilient contacts are positioned on the interior of the output connector housing in a position so that contacts can be mated only after the input contact members are moved in two directions, first longitudinally through the housing openings and then laterally into engagement with the resilient contacts. The input contact members are preferably L-shaped members with a contact interface adjacent the rear or inner included angle where the lateral front foot of the input member meets the longitudinal shank.

In the preferred embodiment, both the input and output connectors include spring loaded covering means that are shiftable during mating. A door closes the openings in the output connector until the input contact members engage the door to push the door open as the input contact members are inserted longitudinally through the output connector openings. A spring loaded shield surrounds the input contact members on the input connector and the shield is forced against the spring as the surrounding shield engages the exterior protruding front wall of the output connector as the input contact members are inserted through the output connector openings. The input contact members are fixed to the body of the console or case so that the input contact members move with the console or case when the console or case is mounted in position and as the input and output connectors are simultaneously mated. However the shield moves relative to the remainder of the input connector and the door moves relative to the other components of the output connector.

This apparatus or assembly serves to establish an electrical connection to a removable console or case at the same time that the console or case is physically mounted in a vehicle or other host. This apparatus is specifically intended to be mounted in a motor vehicle so that portable electronic devices such as laptop computers, cellular telephones and GPS receivers can be easily removed from the vehicle as a unit.

For such a device, these electrical connectors must be and are adapted to be mated by simple movements. The input and output connectors are mated by initially moving the console or case in a longitudinal direction followed by movement in a lateral direction. This is consist with the simple L-shaped movement that is commonly used to physically mount such devices so that they are securely mounted and will not be easily dislodged.

When these devices are to be used in a motor vehicle or other host, it is also important that a user or occupant, and especially a child, cannot come into contact with live conductors when the output connector is exposed. Since the connectors must carry relatively high currents, so that a number of portable devices can be simultaneously powered, preventing inadvertent contact is especially important. By offsetting live contacts relative to normally closed opening in the output connector and by employing doors that cannot be easily opened except during mating with a companion electrical connector, this assembly achieves that purpose.

These and other objectives can be met by the electrical connector assembly described in the following detailed description and the accompanying drawings.

BRIEF DESCRIPTION OF THE DRAWINGS

FIG. 3 is a three dimensional view of the assembled output electrical connector that is shown in FIG. 2.

FIGS. 6–10 are schematic views showing the manner in which the input connector in the removable console is mated with the output electrical connector.

FIG. 6 shows the exterior of the output connector.

FIG. 7 shows the exterior of the input connector.

FIG. 8 shows the input connector positioned opposite the output connector before the removable console is moved into position where the input and output connectors are mated.

FIG. 9 shows an intermediate position with the input connector members inserted longitudinally, or along the principal axis of the input connector member, into the interior of the output connector, but before the electrical contacts on the two connectors are brought into engagement.

FIG. 10 shows the mating condition of the electrical connectors after the input contact members have been moved laterally into engagement with contacts in the output connector.

FIGS. 11–14 are schematic views showing the mating of an alternate version of this invention in which the input contact members are not shielded or covered.

FIG. 11 shows the output connector.

FIG. 12 shows the location of the components just prior to mating.

FIG. 13 shows the intermediate position in which the input contact members have engaged the door, but before the input contact members are mated with the output contacts.

FIG. 14 shows the mated contacts after the input contact members have been laterally moved.

FIG. 15 is a view showing a third embodiment employing redundant contacts.

DETAILED DESCRIPTION OF THE PREFERRED EMBODIMENTS

Figure 1:
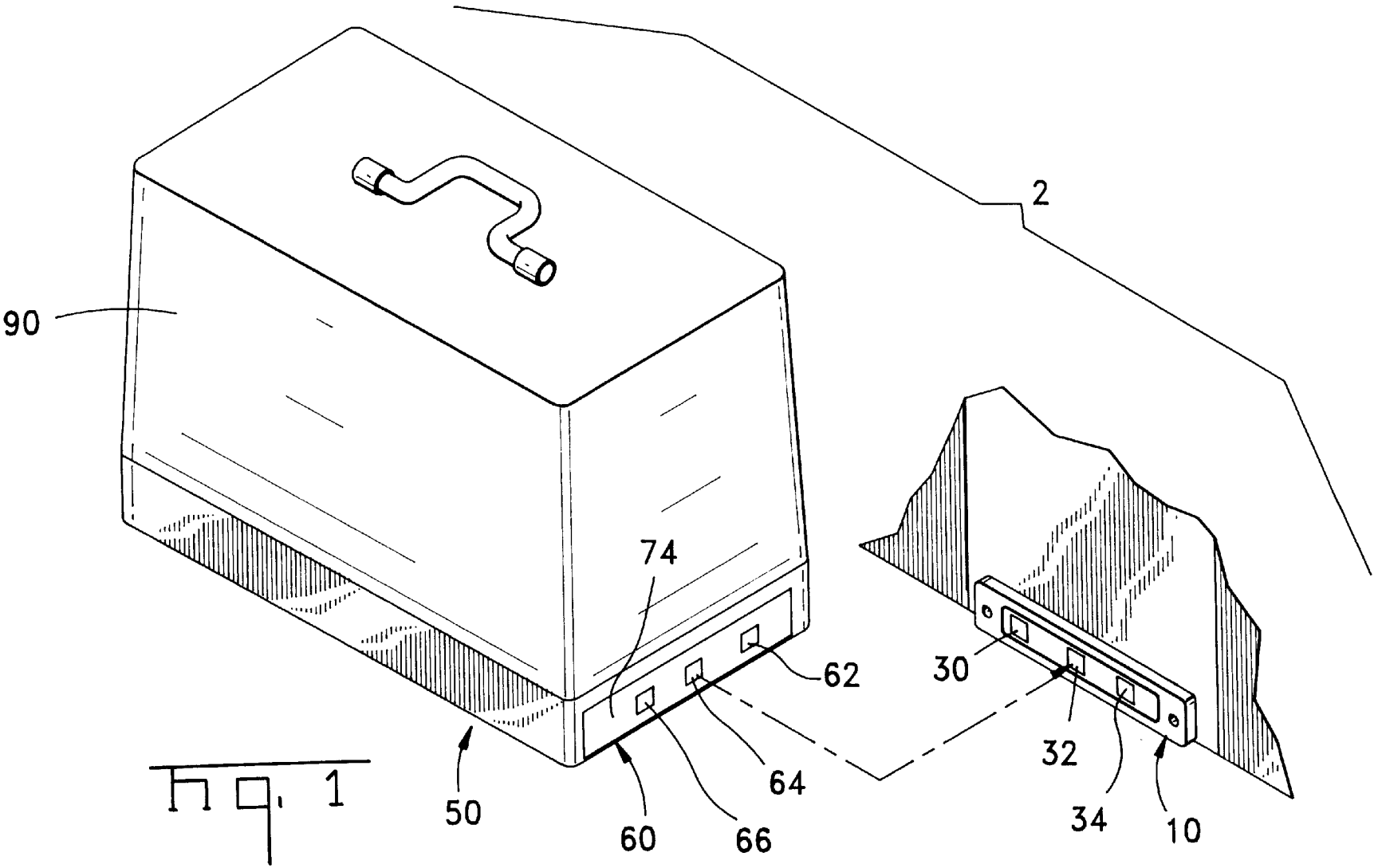
FIG. 1 is a view of the connector interface on the side of a removable console or container and on a surface where the removable console or container will be mounted.

The preferred embodiment of this invention comprises an assembly 2 for connecting multiple electronic components to a source of electrical services by mounting a removable console or case 50 in a position where an input electrical connector 60 is mated with an output electrical connector 10. This portable electronic component transport and interconnection assembly 2 can be used to connect to electrical power, a ground reference and to a signal input or output. FIG. 1 shows that an embodiment in which a removable console, case container, briefcase or carrier 50 can be positioned or mounted so that an input electrical connector 60 is mated to an output or socket electrical connector 10 that is typically permanently connected to the electrical services. In the preferred embodiment of this invention, the output or socket connector 10 is permanently mounted to a wall or partition in an automobile and the removable console or case 50 can either be mounted in the automobile, or it can be removed for security or for other reasons. The console or case 50 is mounted first by longitudinally moving the case 50 into position adjacent the wall or partition and by then moving the case 50 laterally to both mechanically secure the case in position and to bring the input connector 60 into mating electrical contact with the output connector 10. The case can be removed by initially moving the case laterally relative to the output connector 10 and then longitudinally to remove the input electrical contacts in the input connector 60 from the output or socket connector 10.

Figure 2:
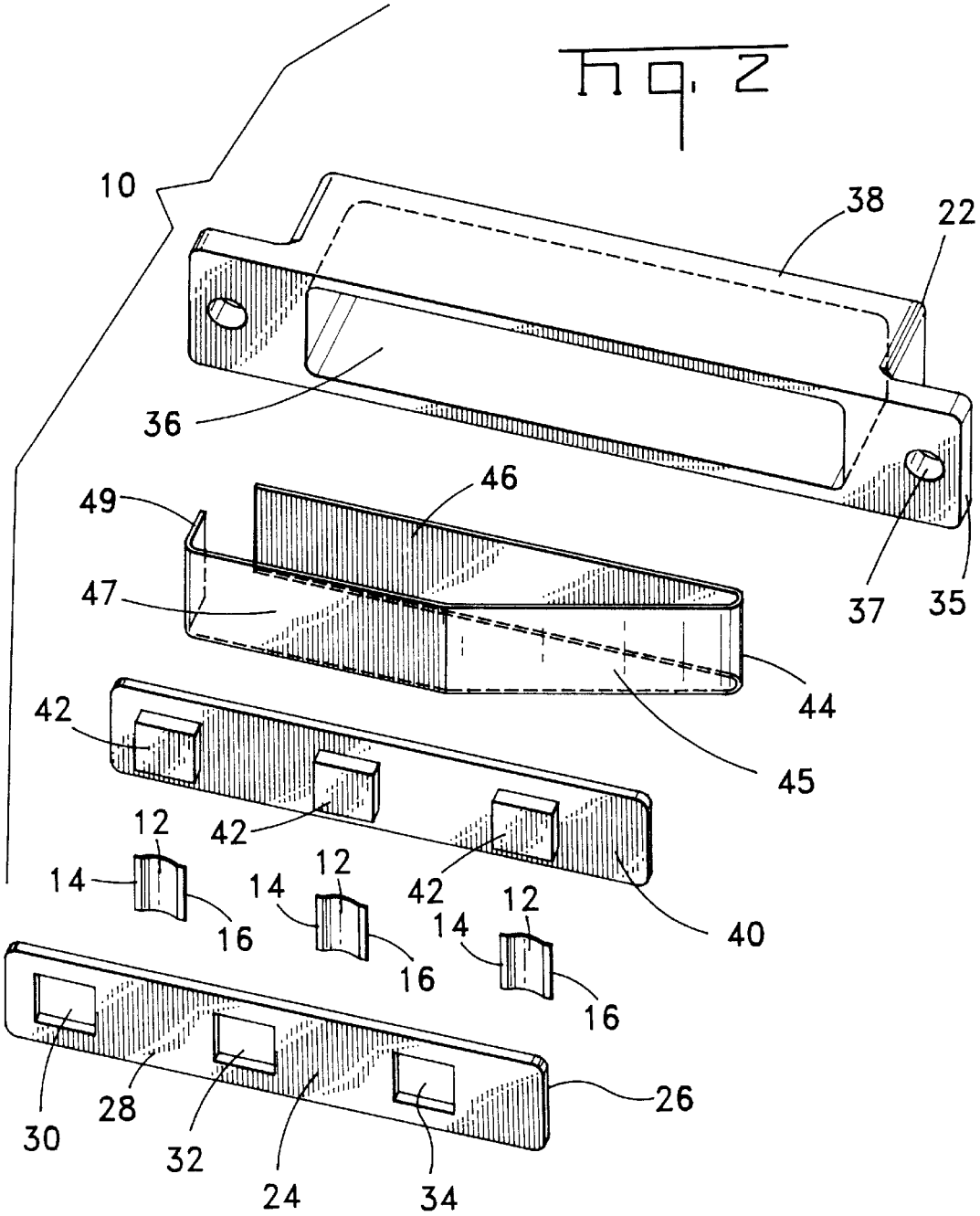
FIG. 2 is an exploded three dimensional view of the components of an output electrical connector that is permanently mounted as part of the assembly including the source of electrical services to which electronic components carried in the removable console are to be mounted.
Figure 16:
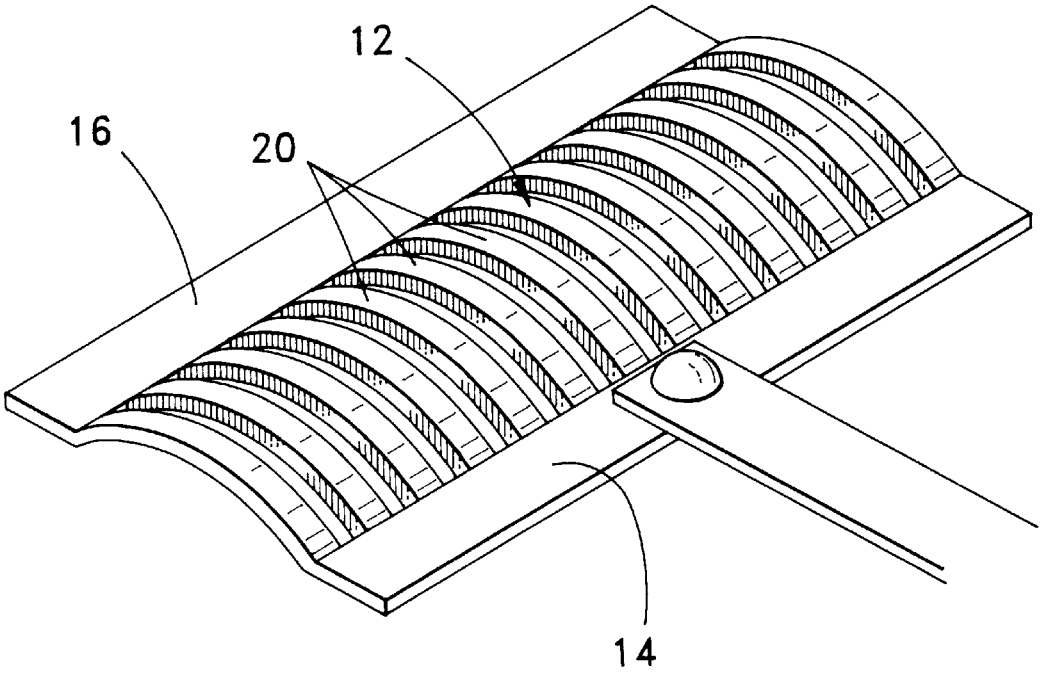
FIG. 16 is a view showing the preferred embodiment of the resilient electrical contact used in the output connector.

The output electrical connector 10 includes separate resilient electrical contacts 12, best shown in FIGS. 2 and 16, that are separately attached to a different electrical service, such as power, ground or signal. Each resilient contact 12 comprises a LOUVERTEC contact of the type manufactured by AMP Incorporated. LOUVERTEC IS A TRADEMARK OF THE WHITAKER CORPORATION. Electrical contacts of this type are described in more detail in U.S. Pat. No. 5,340,338 which is incorporated herein by reference.

Resilient electrical contacts 12 comprise curved, i.e. concave or convex, members stamped and formed from a resilient material such as beryllium copper or other metals commonly used for electrical contacts. Each contact includes a plating, such as a gold, silver or tin plating. In the representative embodiment depicted herein, each contact 12 includes a fixed end 14 and a free end 16 on opposite sides of the curved section 18. The fixed end 14 is mounted on a substrate or wall on which the contacts 12 are located and this fixed end 14 is attached to an electrical conductor or printed circuit board by crimping or riveting the conductor to the fixed end 14 as shown in FIG. 16. The opposite end 16 is free to move laterally when the resilient contact 12 is flexed. The curved section 18 comprises a series of louvered straps 20 separated by gaps stamped from the material. The bowed, curved or convex louvered straps 20 in curved section 18 are flexible and when a mating contact is moved laterally into contact with the curved section 18, the louvered straps flex or flatten generating sufficient contact force to maintain a good electrical connection. Thus the louvered straps 20 deflect radially and transversely, relative to the curvature of the curved section 18 when a mating contact member is brought laterally or transversely into contact with the resilient contacts 12. It should be understood, however, that the resilient contacts could also be incorporated as part of a male pin, including a surrounding louvered contact, or a female socket, with a circumferential louvered contact located on the interior of the female contact. In other words a pin and socket configuration, using a louvered contact could be substituted for the contact configuration depicted in the preferred embodiment. Regardless of the specific configuration employed, louvered contacts of this type are rated to carry 20 amps or more.

FIG. 2 shows the output connector 10 in which the resilient contacts 12 are used. This output or socket connector 10 is permanently mounted on a wall, partition or floor of a larger assembly containing the electrical services supplied through connector 10. For example, the output or socket connector 10 could be mounted on a wall, partition or floor of an automobile and electrical power, a ground reference and signal communication could be accessible through the connector 10. In the representative embodiments depicted herein, the connector 10 is shown as if it were mounted on a vertical surface. It should be understood however that the connector 10 could also be mounted on a horizontal or an inclined surface. In either case the connector 10 is mounted to a wall or partition by screws or other fasteners extending through openings 37 in end flanges 35. When attached in this manner, the front of the connector 10 will protrude beyond the adjacent surface as shown in FIG. 1. Of course, in an alternate embodiment, the output connector could remain flush with the surrounding wall and the input connector on the briefcase could protrude from the surrounding face.

The connector 10 also includes a housing 22 in which the resilient contacts 12 are mounted. This housing 22 includes a housing front wall 24 and a housing base 38. The contacts 12 are mounted on an interior front wall surface 26 and the curved, i.e. concave or convex, sections of contacts 12 face toward the interior 36 of the connector housing 22. The three contacts 12 of the preferred embodiment are located adjacent to three openings 30, 32, and 34 in the front wall 24. In this embodiment separate resilient contacts 12 are located beside a power opening 30, a ground opening 32 and a signal opening 34. In other embodiments, the resilient contacts 12 could be located below or above corresponding openings. Preferably, though not necessarily, the fixed end 14 is closest to the corresponding opening. The size of the contact is a function of the current carrying requirement.

Figure 4:
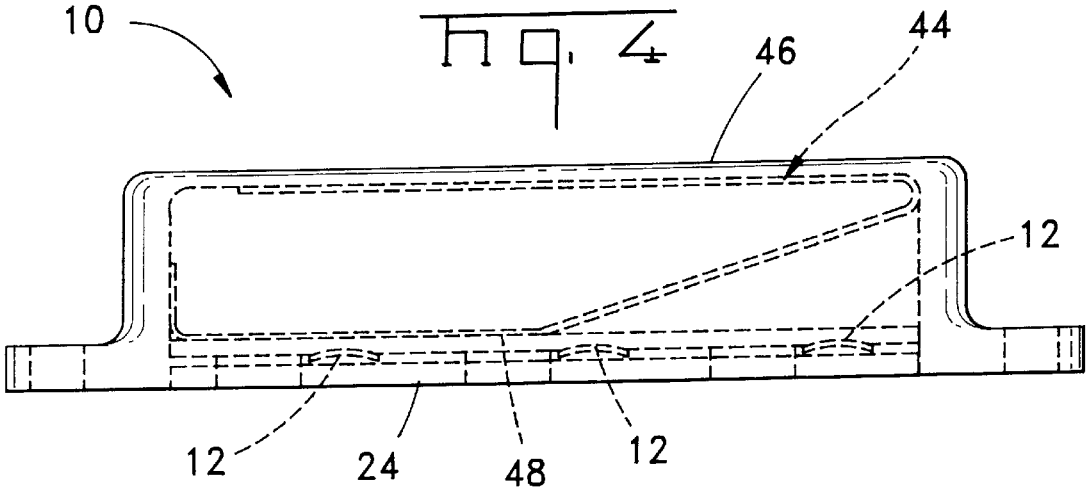
FIG. 4 is a side view of the output electrical connector of FIGS. 2 and 3 showing the position of the spring (in phantom) relative to the spring biased door that normally closes openings in the output connector.

Each of the openings 30, 32 and 34 is normally closed by a door 40 that includes projections 42 dimensioned to fit within a corresponding opening. The door 40 is spring loaded so that it normally closes all of the openings on the front wall 24 so that the contacts 12 are not accessible. Therefore inadvertent contact cannot be made with resilient live contacts, capable of carrying a current that could prove dangerous. Door 40 also prevents contamination of the contacts 12 from liquids that may be spilled on a floor or a wall on which the connector 10 is mounted. The door 40 is held shut by a spring 44 that is located between the rear of the door 40 and the back wall of the housing base 38. This spring includes a rear reaction or fixed surface 46 that engages the housing base 38 and a front or deflectable portion 48. The deflectable portion 48 in turn includes a front flat section 47 located adjacent to the distal end of the spring 44. As shown in FIGS. 3 and 4, this front flat section 47 engages the door 40 adjacent one end so that the resultant spring force exerted on the door 40 is not centered. This flat section 47 joins an inclined section 45 that is sloped away from the door 40. Offsetting the spring force on the door 40 in this manner means that force must be simultaneously exerted on the door at spaced locations in order to open the door 40. Force applied through only one of the openings 30, 32, 34 will cause the door to cock and not fully open. This insures that the door 40 can only easily be opened by force applied through a mating connector that engages the door 40 simultaneously through all of the openings in the front wall 24. The spring also includes a stop 49 at the distal end to ensure that the spring can only be deflected between prescribed limits. Instead of employing a single spring, as depicted in the preferred embodiment, multiple individual springs can be employed and positioned so that the door will only open sufficiently to permit access to the contacts when a force is simultaneously exerted at multiple spaced locations.

Figure 5:
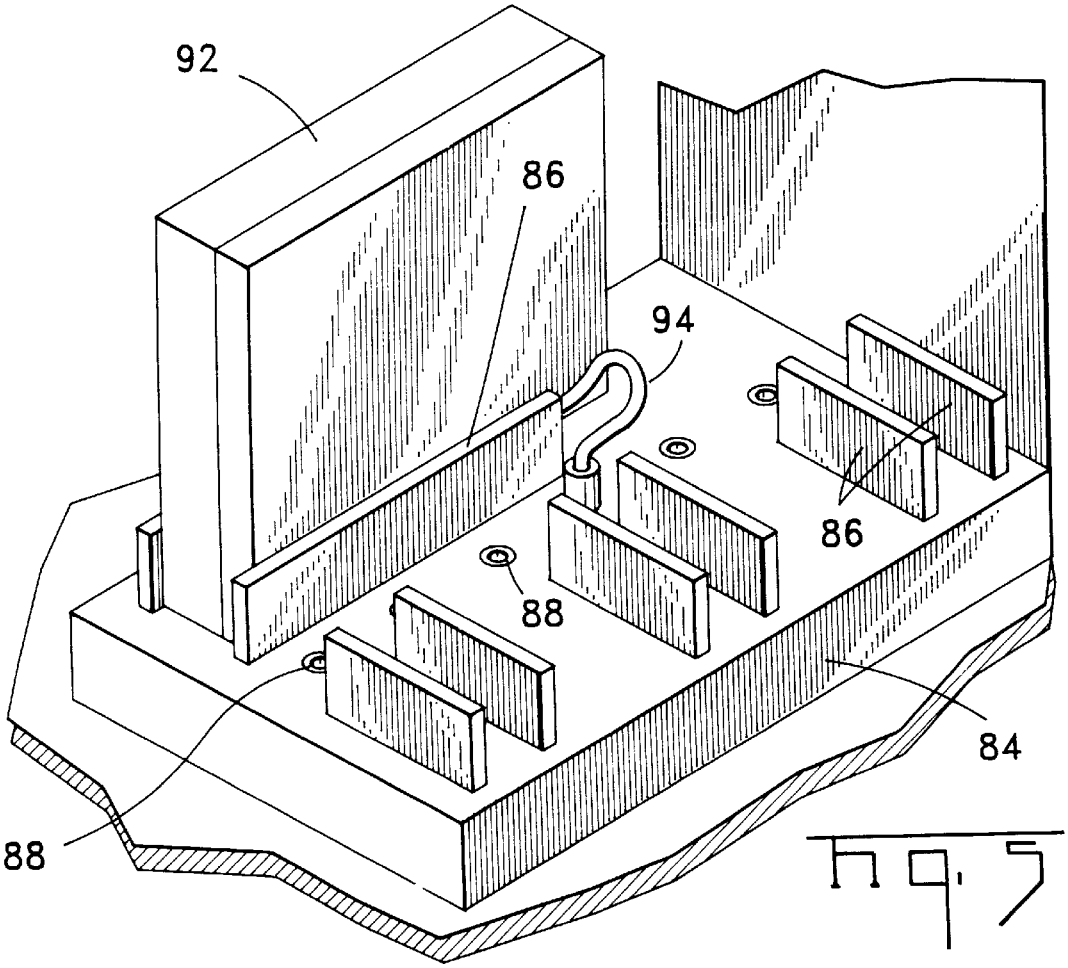
FIG. 5 is a partial three dimensional view showing the manner in which multiple portable electronic devices, such as a laptop computer, can be housed on the interior of the removable console, and showing that the individual devices can be connected to one or more busses in the removable console.

A disengagable connection can be established between this output connector 10 and the input connector on the removable console or case 50 so that electrical services, such as power, ground and signal communication can be established with electronic devices or components that are house in the removable console or case 50. The input connector 60 includes three separate input electrical contact members 62, 64, 66 that are located side by side on the same centerline spacing as the three openings 30, 32, 34 on the output connector 10. In this embodiment, power is supplied through the input member 62, with a ground reference established by input member 64, and with input member 64 providing low voltage signal communication to one or more of the devices located in the removable console 50. As shown in FIG. 5, components, such as a laptop computer 92 can be connected to power supplied through input contact member 62 by plugging a standard power supply cable 94 into one of the power supply ports 88 located on the base 84 of case 50. An internal bus (not shown) of conventional construction connects the input ports 88 to the power input. A ground bus (also not shown) also connects the ground input member 64 to the ports 88. Signal communication between signal input member 68 and signal ports or connections (not shown) would be provided in the same manner.

FIGS. 6–10 show both the configuration of power input electrical contact member 62 and the manner in which each of the input electrical contact members 62, 64, 66 are mated with the input connector 10 and with respective resilient contacts 12 located adjacent to openings 30, 32 and 34 that correspond respectively to input contact members 62, 64, 66. Only the power input member 62 and the power opening 30 are shown in the schematic views of FIGS. 6–10, but it should be understood that in the preferred embodiment, the connections between ground and signal paths would be established in the same manner.

In the preferred embodiment, each of the input contact members 62, 64 and 66 comprise L-shaped members having a longitudinal shank section 68 and a lateral foot section 70 located at the forward, mating or distal end of the respective input contact member 62, 64 or 66. A contact interface 72 in the form of a conductor bonded to the input contact member 62 is located on the rear or inner surface of the L-shaped contact member 62. At least the portion of the contact interface 72 located on the inner surface of foot 70 is suitable for establishing a disengagable electrical contact with the corresponding resilient contact 12 in the output connector 10.

Each of the input electrical contact members 62, 64 and 66 is normally positioned so that the exterior surface of foot 72 is flush with a shiftable shield 74 on the exterior of the input connector 60 on one exterior surface of the removable console, case or container 50. Shield 74 can be fabricated from a conductive metal so that it provides a ground reference and ESD shielding or it can be a nonconductive member, such as a plastic member. The shield 74 is in turn spring loaded with respect to the body of the case 50.

Figure 7:
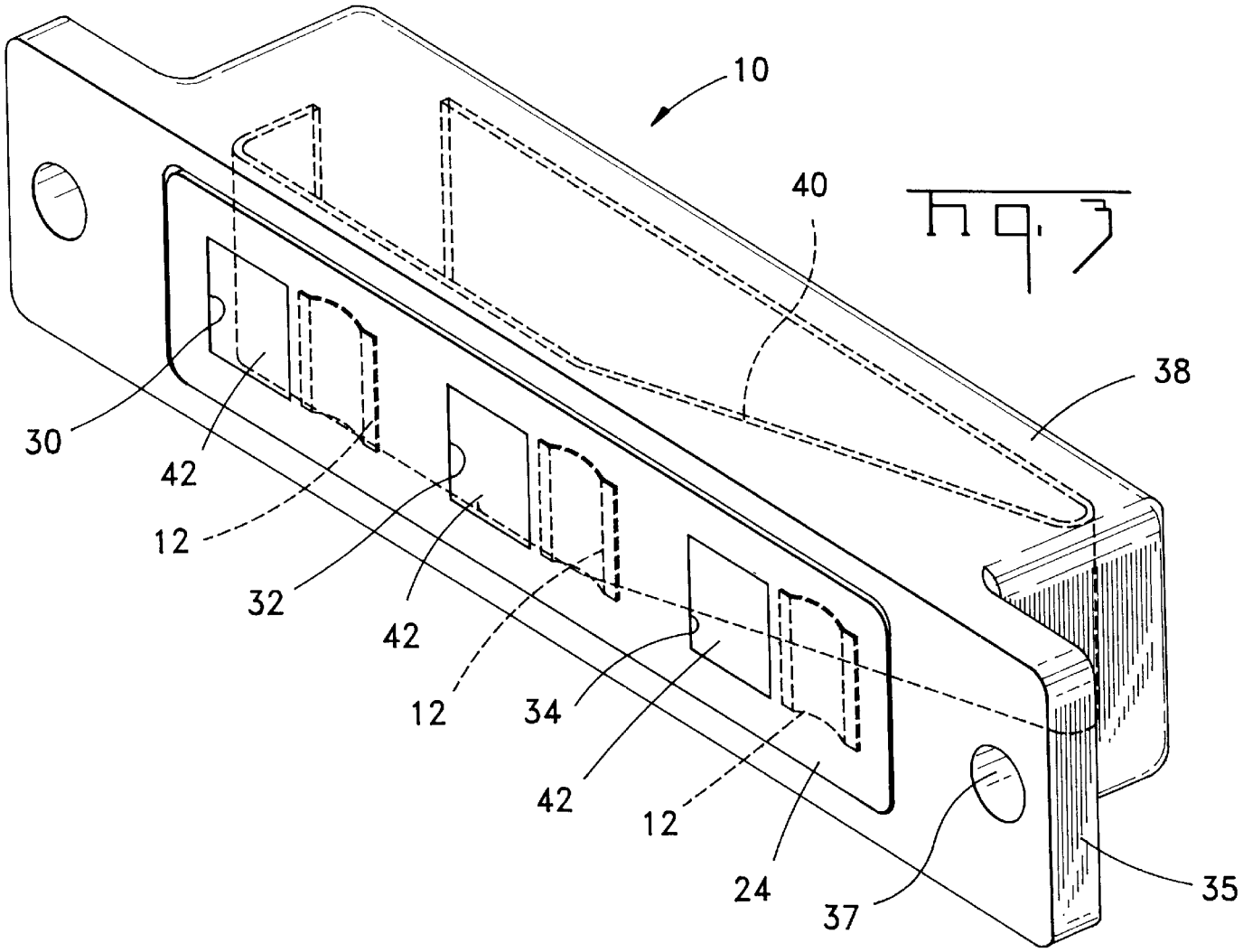
Figure 9:
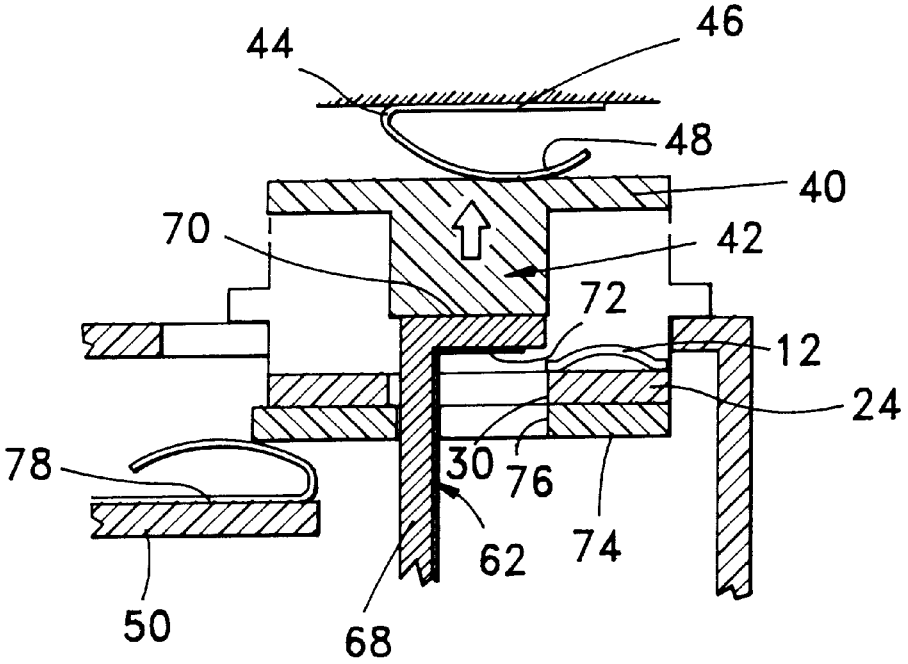

Spring 78 is positioned between the body 50 and the shield 74. The base 80 of spring 78 fits against the body 50 and the deflectable spring portion 78 engages the shield 74. As shown in FIG. 9, the shield 74 is deflected inwardly toward the body 50 when as the two connectors are mated. Referring to FIGS. 6 and 7, it can be seen that the shield 74 surrounding the input members 62, 64, 66 moves during mating while it is the door projections 42 extending through openings 30, 32, 34 that move when the output connector 10 mates with the input connector 60. In other words, the front wall 24 does not move with respect to the contacts 12 during mating, and the input contacts 62, 64, 66 that are fixed to the console or case 50 during mating.

Figure 10:
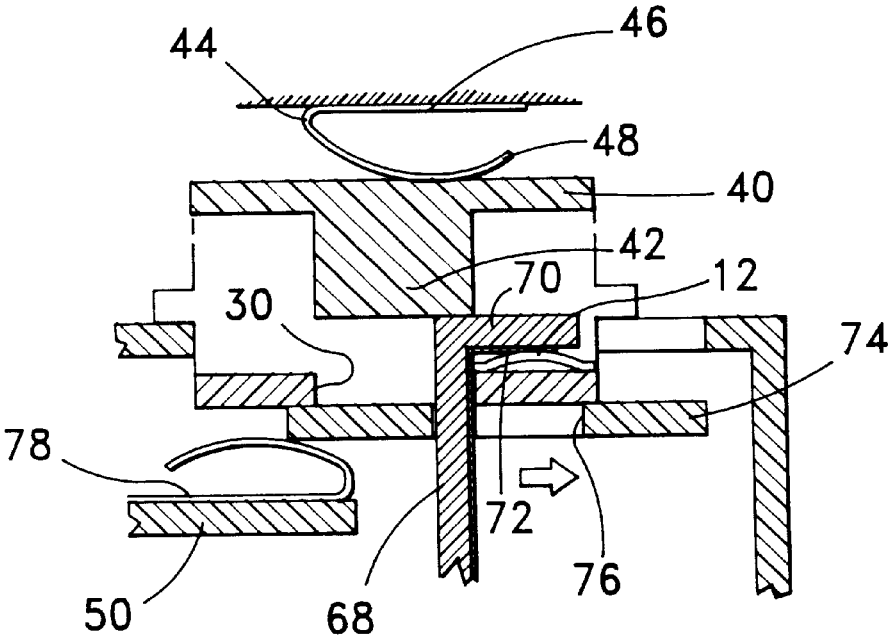

As shown in FIGS. 9 and 10, the input connector 60 is mated to the output or socket connector 10 by two separate movements. FIG. 9 shows the initial longitudinal movement of one input contact member 62 relative to the resilient contacts 12 on the output connector 10. However as shown in FIG. 9 upon completion of this longitudinal movement (perpendicular to the door 40 and the shield 74) the contact interface 72 on the inner surface of input contact member 62 has not come into contact with the corresponding resilient contact 12. Lateral movement of the input contact member 62 relative to the resilient contact 12, as shown in FIG. 10 is necessary to bring the contact interface 72 into engagement with the curved resilient contact 12 in the output connector 10. As shown in FIG. 10, the input contact member 62 and the shield 74 both move laterally relative to each of the components of the output or socket connector 10. During this lateral movement, the free end 16 of the resilient contact 12 is free to move as the curved portion 18 if partially flattened to generate the contact forces that establish a reliable electrical connection. The relative longitudinal and lateral movement depicted in FIGS. 9 and 10 is caused by moving the console or case 50 into mounted position. Simple linear movement of the case 50 in two directions is the only movement necessary to attach the case in place. Simple mechanical fasteners, such as L-shaped brackets or key and slot configurations (not shown) are compatible with this movement and would serve to anchor the removable case or console in place and prevent inadvertent dislodgment. The case or console 50 can be removed and the connectors 10 and 60 by lateral movement followed by longitudinal movement in the reverse directions from that shown in FIGS. 9 and 10.

FIGS. 11–14 are similar to the schematic views of FIGS. 6–10, but these views show an alternate embodiment of this invention. This alternate embodiment includes all of the elements of the first embodiment with the exception of the spring loaded shield 74, which has been eliminated from this invention. In this second embodiment the input contact members, represented here by single input contact member 62 are exposed. The input contact member 62 engages the door 40 and is inserted through the opening 30 in the same manner as in the first embodiment. Lateral movement of FIG. 14 is analogous to the lateral movement of FIG. 10. In this second embodiment the input contact member 62 is exposed when the console 50 is mounted in position. Typically a cover for input connector 60 would be removed in an earlier step.

Another embodiment of this invention is shown in FIG. 15. In this embodiment, redundant contact is provided between opposite faces of a contact blade 170 on the input connector member 162 and the two resilient contacts 112 shown on the alternate input connector 110. The two resilient contacts 112 would be mounted in opposition in a channel 113 formed between front wall 124 and a recessed wall 115. The blade 170 can be inserted between the two resilient contacts 112, and the redundant contact will provide uninterrupted contact when the contact interface is subjected to vibration. An auxiliary lateral member 171 is shown on the distal end of the input contact member 162.

The several embodiments depicted herein are intended to be representative of the essential aspects of this invention. It would be apparent to one of ordinary skill in the art that equivalent versions of this invention could also be employed. For example, one alternative would be to replace the curved resilient spring 12 of the preferred embodiment for the signal connection. The main purpose for using a curved spring or band 12 is the need to carry high currents for the power contact, and in emergency situations through a ground return. High current capacity is not needed for a signal connection that, for example, connect an antenna to a GPS device located in the remote console 50. Other contacts could therefore be used to replace the signal contact. For example, more than one signal line may be needed, and this invention is compatible with more than one signal input line. It would also be possible to substitute a multiple pin header in the input connector and a receptacle connector in the input connector for the signal contact. This would be true if multiple contact lines, as required for various signal communication protocols, or for different signal input and output sources, were to be added to permit more complex signal information to be communicated to and from one or more devices mounted in the removable console 50. This invention is also compatible with a system in which only signal communication is employed. Therefore the invention represented by the alternate embodiments described in detail is defined by the following claims and is not limited to the specific embodiments depicted herein.

We claim:

1. An electrical connector for use in electrically connecting portable electrical components, the electrical connector comprising:

resilient electrical contacts deflectable upon engagement with input electrical contact members leading to the portable electrical components, separate contacts for power and ground being spaced apart;

a housing in which the electrical contacts are positioned, the housing including a front wall with multiple openings, each opening being located adjacent to a corresponding resilient electrical contact;

spring biased door means normally closing each of the openings, the door means being shiftable when engaged by the input electrical contacts to permit insertion of the input electrical contact member through corresponding openings;

the electrical connector being characterized in that the resilient electrical contacts are positioned relative to adjacent openings so that the input electrical contact members must be shifted laterally of the corresponding opening after insertion through the corresponding opening to bring the input electrical contact members into engagement with corresponding resilient electrical contacts to establish power and ground connections to the portable electrical components.

2. The electrical connector of claim 1 wherein the resilient electrical contacts are located on an interior surface of the front wall adjacent corresponding openings.

3. The electrical connector of claim 1 wherein the resilient contacts are positioned adjacent corresponding openings so that the input electrical contact members can be brought into electrical engagement with corresponding resilient contacts by linear lateral movement after insertion of the input electrical contact members through corresponding openings.

4. The electrical connector of claim 3 wherein the resilient contacts are positioned adjacent corresponding openings so that the input contacts can be brought into electrical engagement with corresponding resilient contacts by lateral movement perpendicular to the principal insertion direction traversed by the input electrical contact members during insertion of the input electrical contact members through corresponding openings.

5. The electrical connector of claim 1 wherein each resilient electrical contact comprises a curved spring having an arc extending in one direction, the curved spring being deflectable upon lateral movement of an input electrical contact member parallel to the arc of the curved spring.

6. The electrical connector of claim 1 wherein each resilient electrical contact is positioned beside a corresponding opening.

7. Apparatus for electrically connecting portable electrical components, the apparatus comprising:

a case in which the portable electrical components can be located;

the case including electrical connector means including at least three spaced apart input contact members for connection to separate electrical services;

a socket containing output contact members matable with the input contact members and spaced apart on the same spacing as the input contact members;

door means on the socket shiftable between a position covering the output contact members and a position exposing the output contact members for mating with the output contact members; and spring means engaging the door means, the spring means preventing the door means from moving to the position exposing the output contact members unless the door means is engaged by the three spaced apart input contact members.

8. The apparatus of claim 7 wherein the door means comprises a single door closing multiple openings.

9. The apparatus of claim 8 wherein the door includes projections extending through corresponding openings in a front wall of the socket when the door is in the position covering the output contact members so that the projections extend at least to an exterior surface of the front wall for engagement with input electrical contact members during insertion of the input electrical contact members through corresponding openings.

10. The apparatus of claim 7 wherein the case includes a shield surrounding the input contact members, the shield being spring loaded so that the shield is shiftable to a position exposing the input contact members when engaged by the socket.

11. Apparatus for use in delivering electrical power and providing a ground connection to portable electrical components, the apparatus comprising:

input electrical contact members including means for establishing an electrical path to the portable electrical components, each input contact member including an exposed contact interface;

an electrical connector including a housing and resilient contacts positioned adjacent openings in a front wall of a housing, and located on the interior of the housing, the housing also including door means for closing the openings when the input electrical contact members are not mated with the electrical connector;

the apparatus being characterized in that the resilient contacts face away from the openings and toward the interior of the housing, and the exposed contact interface on each input contact member is located on a rear surface of the input contact member, the exposed contact interface being engagable with a corresponding resilient contact only upon lateral movement of the corresponding input electrical contact member relative to each resilient contact member after insertion of the input electrical contact member through the opening, the input contact members engaging the door means to expose the openings prior to lateral movement to mate the exposed contact interfaces with corresponding resilient contacts.

12. The apparatus of claim 11 wherein the input contact members are affixed to a case containing multiple portable electrical components.

13. The apparatus of claim 12 wherein the case includes a shield surrounding the input contact members, the shield being shiftable to permit insertion of the input contact members through the openings.

14. The apparatus of claim 13 wherein the shield is spring loaded relative to the input contact members.

15. The apparatus of claim 14 wherein the input contact members extend through apertures in the shield.

16. The apparatus of claim 14 wherein the door means and the shield are shiftable in opposite directions when the input contact members are inserted through the front wall openings.

17. The apparatus of claim 11 wherein the input contact members and the openings in the housing front are positioned side by side in a line.

18. The apparatus of claim 11 wherein each resilient electrical contact comprises a convex spring, one end of which is fixed to the housing front wall, the other end of the convex spring being free to move upon engagement with a corresponding input contact member.

19. The apparatus of claim 11 including separate power, ground and signal input contact members and resilient electrical contacts.

20. The apparatus of claim 11 wherein the door means is shiftable to an open position only upon engagement by multiple input contact members.

21. An electrical connector for use in delivering electrical power and providing a ground connection to portable electrical components, the electrical connector comprising:

resilient electrical contacts deflectable upon engagement with input electrical contact members leading to the portable electrical components, separate contacts for power and ground being spaced apart;

a housing in which the electrical contacts are positioned, the housing including a front wall with multiple openings, each opening being located adjacent to a corresponding resilient electrical contact;

spring biased door means normally closing each of the openings, the door means being shiftable when engaged by the input electrical contacts to permit insertion of the input electrical contact member through corresponding openings;

the electrical connector being characterized in that at least the resilient electrical power contact comprises a curved louvered spring, the curved louvered spring being resiliently deformable in a transverse direction and in a radial direction when engaged by an input electrical contact member to establish a disengagable electrical pressure connection with the input contact member.

22. A removable console assembly for use in an automobile, the removable console assembly comprising a case and a socket, the case being removable from the automobile and including a means for delivering power to multiple portable electrical components carried in the case and input contact members for connecting the case to an electrical socket, the socket being mounted in the automobile with the case being separable from the socket; the socket including output contact members attached to one or more electrical services in the automobile; the removable console assembly being characterized in that the input contact members are surrounded by a shiftable shield and the output contact members are positioned adjacent openings with door means closing the openings unless the input contact members are inserted through the openings into engagement with the output contact members; and the input contact members are surrounded by the shield that is shiftable to permit the case to be mated with the socket.

23. The removable console assembly of claim 22 wherein the shield is spring loaded relative to the case and the door means are spring loaded relative to a socket housing.

24. The removable console assembly of claim 22 wherein the input contact members can be mated to the output contact members only by longitudinal insertion of the input contact members through the socket openings followed by lateral movement of the input contact members into engagement with the output contact members.

25. The removable console assembly of claim 24 wherein the output contact members comprise resilient contact members.

26. The removable console assembly of claim 22 wherein the input contact members comprise separate power, ground and signal contact members and the output contact members comprise separate power, ground and signal contact members.

27. The removable console assembly of claim 26 wherein the input power contact member and the output power contact member are capable of conducting up to 20 amps.

* * * * *